United States Patent [19]

Roccaforte

[11] 4,128,168

[45] Dec. 5, 1978

[54] DISPLAY CARTON WITH RETAINING PANELS

[75] Inventor: Harry I. Roccaforte, Western Springs, Ill.

[73] Assignee: Champion International Corporation, Stamford, Conn.

[21] Appl. No.: 848,502

[22] Filed: Nov. 4, 1977

[51] Int. Cl.[2] ..... B65D 5/50

[52] U.S. Cl. ..... 206/45.14; 206/277; 206/476; 206/486; 206/491; 229/16 D

[58] Field of Search ..... 229/16 D; 206/418, 45.14, 206/45.19, 45.31, 277, 476, 485, 486, 488, 491

[56] References Cited

U.S. PATENT DOCUMENTS

| | | | |
|---|---|---|---|
| 3,252,566 | 5/1966 | Hanson | 206/45.19 |
| 3,330,465 | 7/1967 | Davidson et al. | 206/45.14 |
| 3,378,137 | 4/1968 | Stone | 206/45.14 |
| 3,482,678 | 12/1969 | Mason | 206/45.14 |
| 3,687,279 | 8/1972 | Stone | 206/45.19 |
| 3,887,067 | 6/1975 | Collura et al. | 206/277 |
| 4,054,203 | 10/1977 | Farquhar | 206/45.14 |

*Primary Examiner*—William Price
*Assistant Examiner*—Bruce H. Bernstein
*Attorney, Agent, or Firm*—Evelyn M. Sommer

[57] ABSTRACT

A display carton for an elongated bottle which is substantially equal to the length of the carton, but is of smaller width than the carton, is provided with top and bottom retaining panel structures to prevent lateral movement of the bottle within the carton. Each retaining panel structure includes a first flap pivotally connected to the back panel of the carton, and having, in turn, a glue flap hingedly attached thereto. Hingedly connected to the opposite edges of the glue flap are two spaced tabs, with the combined length of the tabs and the glue flap being greater than the length of the first flap. By this arrangement, the first flap is disposed in abutting relationship to the end flap closure of the carton, and the glue flap is bonded to the first flap. The spaced tabs are wholly disposed within the carton and extend at an angle to the back panel so as to form with the first flap and the back panel a right triangle. The tabs are so configured to define a central opening corresponding to the configuration of the end of the elongated bottle. By this arrangement, the bottle is restrained from lateral or sideways movement within the carton.

11 Claims, 10 Drawing Figures

DISPLAY CARTON WITH RETAINING PANELS

BACKGROUND OF THE INVENTION

1. Field of the Invention

The subject invention relates to display cartons of the type having retaining panels and having shadow panels, and which have particular structures built into the end flaps which are foldable into retaining panel structures to support and restrain the ends of the article from lateral shifting within the display carton.

2. Description of the Prior Art

Many display cartons for small objects such as pharmaceuticals or cosmetics that are of the shadow panel variety are hand-loaded and closed. In addition, as disclosed in U.S. Letters Patent No. 4,037,717 of Harry I. Roccaforte entitled "Display Carton" which issued on July 26, 1977, and which is assigned to the assignee of the subject application, display cartons for small objects of the shadow panel variety are also known wherein cushioning structures are provided at the opposite ends of the carton to support and restrain the ends of the article to be displayed away from the ends of the carton. In such construction, the display carton is of greater length than the bottle and the display carton of U.S. Pat. No. 4,037,717 may be automatically erected, loaded, and closed on currently available cartoning equipment.

SUMMARY OF THE INVENTION

The subject invention relates to a display carton for use with bottles wherein the length of the bottle substantially corresponds to the length of the carton, but where one or both ends of the bottle is of smaller width than the carton. The subject invention provides a display carton with retaining panels, as well as a blank for making same, which has a die cut front panel split down the middle to form two shadow panels with top and bottom masking panels extending across the full width of the front panel. Disposed on one or both ends of a major panel is an end flap retaining panel structure which is die cut to include a hingedly connected flap, a glue flap, and a pair of spaced projecting tabs, with the end flap configuration being automatically set up and moved into position to restrain the cap and/or bottom end of the article to be displayed from lateral movement within the carton, and with the opposite ends of the carton being closed either in a locking flap or seal end configuration.

DETAILED DESCRIPTION OF THE PREFERRED EMBODIMENT

Figure 1:
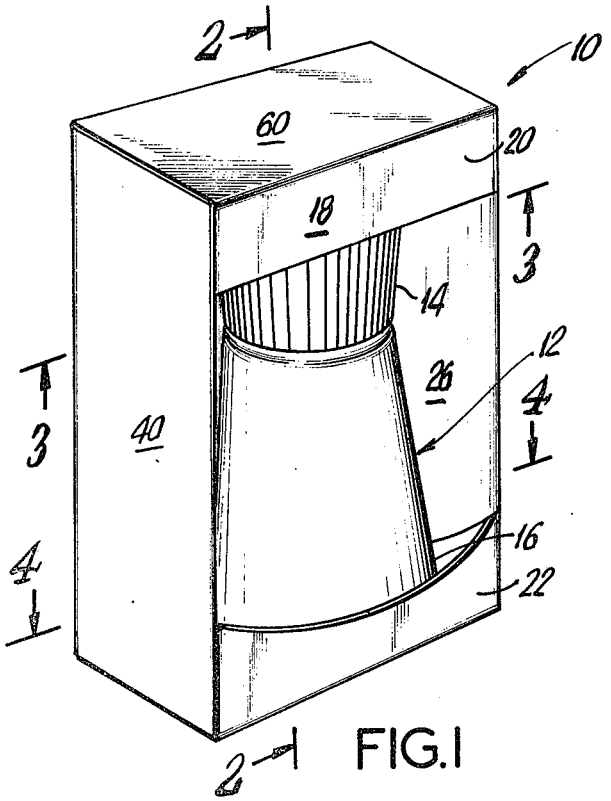
FIG. 1 is a perspective view of an assembled carton containing an article which embodies the present invention.
Figure 2:
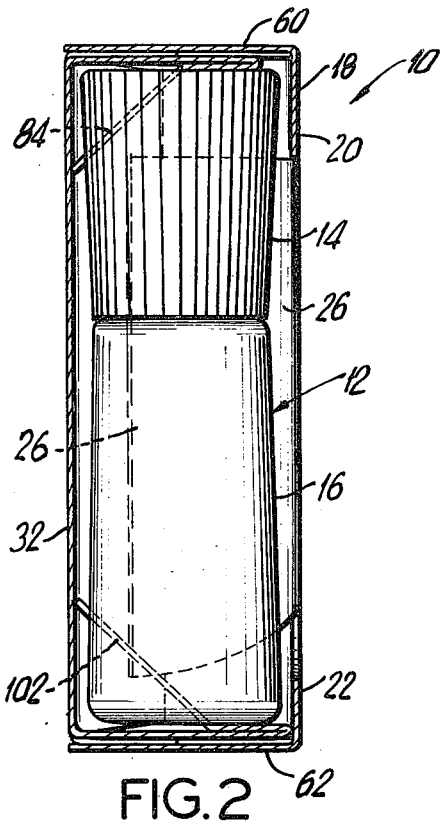
FIG. 2 is a side elevational view of the carton and bottle of FIG. 1 taken along line 2—2 in FIG. 1.
Figure 3:
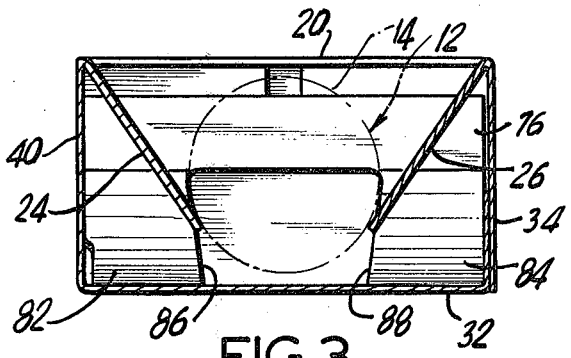
FIG. 3 is a top plan view taken in section along line 3—3 in FIG. 1.
Figure 4:
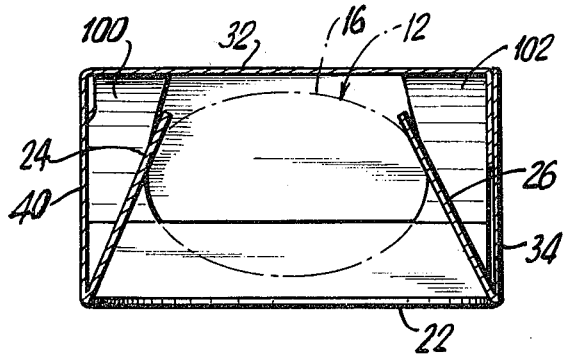
FIG. 4 is a plan view in section taken along line 4—4 in FIG. 1.

Referring to FIG. 1, the display carton with retaining panels of the subject invention is generally designated by the numeral 10 and is provided for holding a bottle 12 during shipment and for display, with the bottle 12 normally containing a phramacuetical or cosmetic substance. The length of the bottle generally corresponds to the total height or length of the carton 10, with the bottle being provided with a cap 14. Bottle 12 is shown as being shaped with an oval base portion 16 (see FIG. 4) which tapers inwardly to a generally circular section near the top, as seen in FIG. 3. The particular cap style which is shown is provided with a larger diameter at the top than at the bottom.

As shown in FIGS. 1 through 4, the front panel 18 includes an upper restraining section 20 and a lower restraining section 22 which extend across the entire width of the carton and thus prevent bottle 12 including cap 14 from moving outwardly after it has been loaded and in position. Two shadow panels 24 and 26 are defined in the front panel and are separated by a cut line 25 (see FIG. 5). The shadow panels 24 and 26, as well as the upper restraining section 20 and the lower restraining section 22 may serve to hold graphics or other aesthetic features for the display carton.

Figure 5:
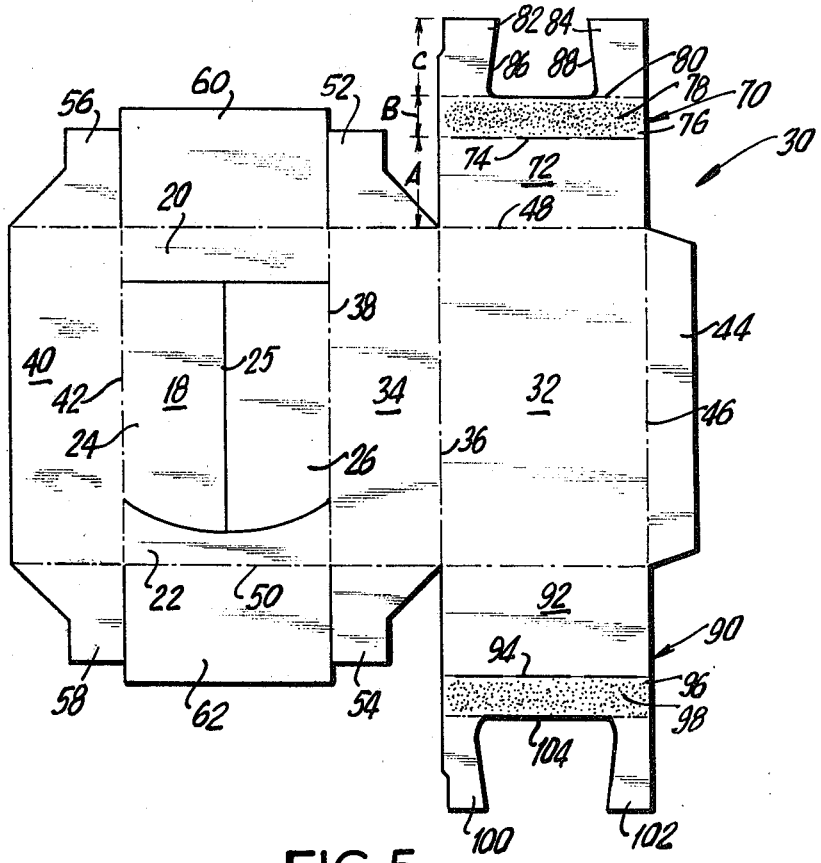
FIG. 5 is a plan view of a blank adapted to be erected into the carton such as shown in FIGS. 1 through 4.

Referring to FIG. 5, the display carton 10 of the subject invention is formed and erected from a foldable blank 30 which is preferably made of sheet-like material such as foldable paperboard, and includes a back panel 32 which is generally rectangular in shape and is hingedly connected to a side panel 34 along fold line 36. In turn, the front panel 18 is hingedly connected to side panel 34 along hinge line 38, while a second side panel 40 is hingedly connected to the front panel along hinge line 42. A conventional manufacturer's joint is formed by means of a manufacturer's glue flap 44 hingedly connected to the back panel along hinge line 46. In other words, the four panels 32, 34, 18 and 40 are connected by the vertically extending hinge lines 36, 38, and 42, and are defined along the top and bottom edges by parallel fold lines 48 and 50, with the four panels being foldable together into a rectangular tubular relationship which is held in place by a conventional manufacturer's joint, including manufacturer's glue flap 44. For closing the opposite ends of the display carton, side panels 34 and 40 have end closure flaps hingedly attached at the top and bottom edges thereof along the fold lines 48 and 50, with said end flaps being designated by the numerals 52 through 58, inclusive. Hingedly attached to the top and botttom of the front panel 18 along fold lines 48 and 50 are end closure flaps 60 and 62 which also form a part of the end closures of the finished display carton.

In the erected carton, as shown in FIG. 1, the end closure flaps 60 and 62 are sealed and glued on top of the remaining structure. Disposed immediately inside of the carton and the end closure flaps 60 and 62 are retaining panel structures for preventing lateral shifting of the bottle 12 within the erected carton in those instances were both the cap 14 and the base portion 16 of the bottle 12 are of less width than the width of the carton. Of course, in those instances in which the base portion 16 of the bottle 12 corresponds in width to the width of the carton, only an upper retaining panel structure is provided. In the particular embodiment illustrated in the figures, both upper and lower retaining panel structures are provided, as the width of both the cap 14 and the base portion 16 of the bottle 12 are smaller than the width of the carton.

As illustrated in FIG. 5, the upper retaining panel structure is designated by the numeral 70 and includes a first flap 72 which is hingedly connected along fold line 48 to the back panel 32. Hingedly connected along fold line 74 (disposed parallel to the fold line 48) is a glue flap 76 to which adhesive 78 has been applied. Extending parallel to the fold lines 48 and 74 is a fold line 80 and hingedly connected to fold line 80 at opposite ends of the glue flap 76 are two spaced tabs, designated 82 and 84. The innermost edge of each tab is preferably die-cut in an arcuate line, designated 86 and 88 respectively, so as to result in a central opening disposed between the extended tabs 82 and 84. It is noted that the length of the first flap is designated by the letter "A", whereas the length of the glue flap 76 is designated by the letter "B", and the length of the extended tabs 82 and 84 is designated by the letter "C". The sum of the lengths "B" and "C" is greater than the length A whereby, in the erected condition of the carton, a retaining panel structure is defined, as more clearly described hereinafter, and as illustrated in FIG. 9.

A similarly constructed lower retaining panel structure is provided and hingedly connected along the fold line 50 to the bottom edge of the back panel 32. The lower retaining panel structure is designated by the numeral 90 and includes a first flap 92 hingedly connected along fold line 94 to a glue flap 96 having adhesive 98 applied thereto. Two projecting spaced tabs 100 and 102 are hingedly connected to the glue flap along hinge line 104 and define a central opening for engaging and restraining the bottom portion 16 of the bottle 12 from lateral movement within the resulting display carton 10. The erected condition of the lower retaining panel structure is illustrated in FIG. 10.

Figure 9:
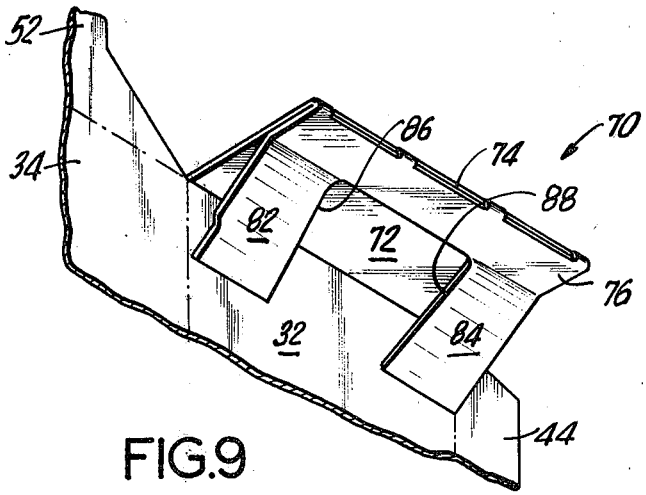
FIG. 9 is a perspective view of the upper retaining panel structure of the display carton illustrating the relationship of the various parts thereof.

Referring to FIG. 9, it can be seen that the first flap 72 extends outwardly from the plane of the back panel 32, and is immediately disposed beneath end closure means formed by flaps 52, 56, and 60. The glue flap 72 is bonded to the lowermost surface of the first flap 72, and by virtue of the relative lengths of the first flap 72, the glue flap 76, and the tabs 82 and 84, the latter extend at an angle to the back flap 32, thereby defining a right triangle with said first flap and the back panel, and a support structure for the bottle cap 14 to prevent lateral movement within the carton. When fully erected, and with the bottle 12 loaded within the carton 10, the upper portion of the cap 14 essentially bears against the lowermost surface of the first flap 72, while the longitudinal side portions of the cap 14 bear against the arcuate portions 86 and 88 of the tabs, thereby restraining the bottle cap from sideways movement while in the carton 10.

Figure 10:
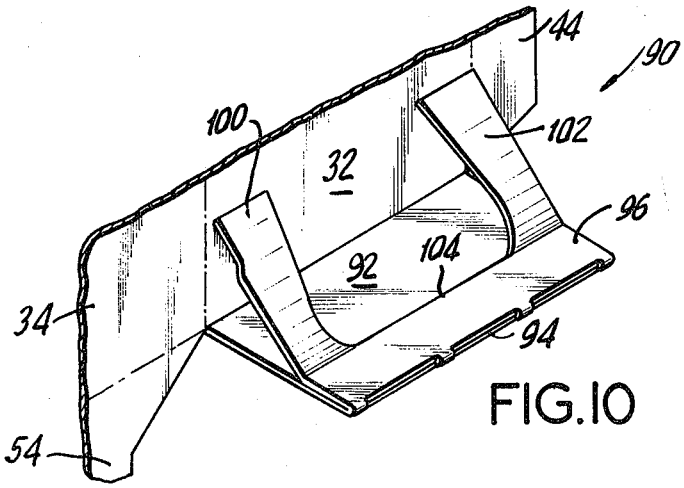
FIG. 10 is a perspective view of the bottom retaining panel structure of the subject invention, with the remainder of the carton broken away.

The bottom retaining structure, as illustrated in FIG. 10, is similar in arrangement, with the curved portions of the tabs 100 and 102 being suitably configured to accommodate the oval configuration of the base portion 16 of the bottle 12.

Figure 6:
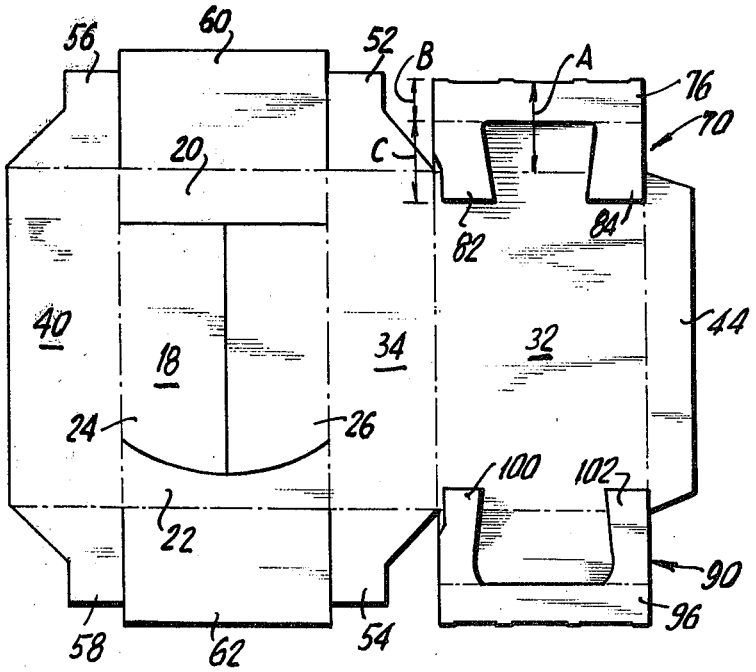
FIG. 6 is a plan view of the blank shown in FIG. 5 but partially folded as would typically be performed on automatic equipment.
Figure 7:
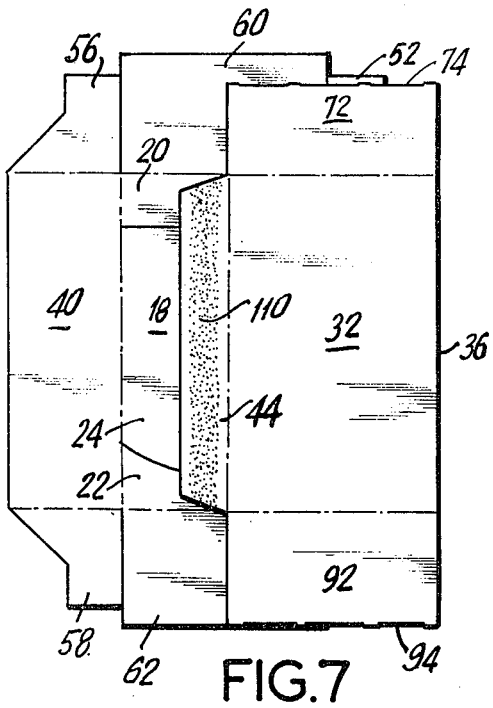
FIG. 7 illustrates a plan view of the blank in FIG. 6 illustrating the next folding step.
Figure 8:
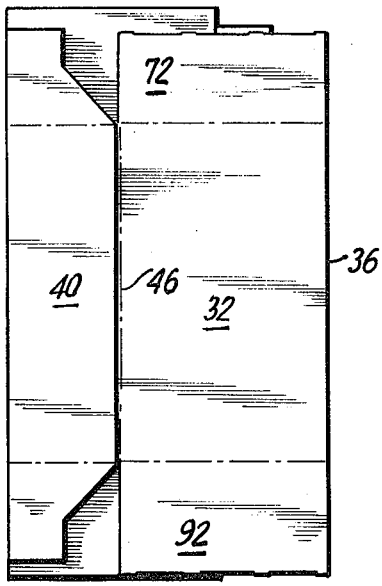
FIG. 8 illustrates the final folded and glued position of the blank of the subject invention prior to loading.

FIGS. 6 through 8 illustrate the steps of forming the generally rectangular carton utilizing automatic equipment. As shown in FIG. 6, the glue flaps 76 and 96, as well as the tabs 80–82 and 100–102 are folded about the respective hinge lines 74 and 94, with the glue flaps 76 and 96 being bonded to the upper and lower first flaps 72 and 92. Next, the sections are folded inwardly about the fold line 36, followed by the application of adhesive 110 to the manufacturer's glue flap 44. As shown in FIG. 8, the second side panel 40 is then folded about hinge line 42 and bonded to the glue flap 44, after which the carton may then be end loaded and sealed on conventional automatic equipment. As a result, the cost of manufacture and assembly of the subject carton is greatly reduced and during the final closure of the upper and lower portions of the carton, the upper and lower retaining panel structures are automatically erected and, by virtue of the configuration of the extended tabs, facilitate the alignment and loading of the bottle 12 within the carton 10. As shown, the carton 10 has a conventional seal end or glue flap arrangement on the top and bottom of the carton.

Accordingly, there is provided a new and improved display carton with retaining panels for accommodating an elongated object such as a cosmetic bottle, where the length of the cosmetic bottle substantially corresponds to the length of the carton, but where one or both ends of the bottle is smaller than the width of the carton. The subject carton is specifically adapted for use on conventional automatic erecting and loading equipment, and by virtue of the new and improved top and bottom retaining panel structures, such structures are automatically erected and assist in the loading of the object within the carton. In the final erected configuration, the upper and lower retaining panel structures prevent sideways or lateral movement of the bottle within the carton during shipment and display.

What is claimed is:

1. An improved display carton with retaining panels for an elongated bottle having at one end a cap, while the other end thereof is a closed based portion, the carton having front, back, and side panels arranged in a generally rectangular tubular configuration with end flaps closing the top and bottom ends thereof, and with the width of the carton being greater than the width of said cap, while the length of the carton substantially corresponds to the length of the elongated bottle, the improvement wherein said retaining panel structure is located at the top of said carton and inside the top closure flaps, said top retaining panel structure including a first flap hingedly connected to said back panel along the top edge thereof and lying on the inside of the top closure of the carton, a glue flap hingedly connected to said first flap and arranged horizontally on and secured to the inside of said first flap, with the glue flap being of smaller length than said first flap from front to back of said carton, and two spaced, projecting tabs disposed on opposite ends of said glue flap and hingedly connected thereto, said projecting tabs being of sufficient length to form a right triangle with said first flap and the back panel thereby providing a central opening corresponding to the configuration of the cap of the elongated bottle, and adapted to receive same.

2. An improved display carton with retaining panels as in claim 1 wherein the edge of each tab forming the central opening is generally arcuate extending from front to rear of the carton such that the central opening is arcuate in configuration.

3. An improved display carton with retaining panels as in claim 1 wherein said glue flap is adhesively bonded to the inside of said first flap.

4. An improved display carton with retaining panels as in claim 1 wherein said front panel includes inwardly directed flaps for forming a shadow box configuration.

5. An improved display carton with retaining panels as in claim 1 wherein the width of the carton is also greater than the width of the base portion of said elongated bottle, and wherein said carton further includes a bottom retaining panel structure located at the bottom of said carton and inside the bottom closure flap, said bottom retaining panel structure including a first bottom flap hingedly connected to said back panel along the bottom edge thereof and lying on the inside of the bottom of the carton, a bottom glue flap hingedly connected to said first bottom flap and arranged horizontally on and secured to the inside of said first bottom flap, the bottom glue flap being of smaller length than said first bottom flap from front to back of said carton, and two spaced, projecting bottom tabs disposed on opposite ends of said bottom glue flap and hingedly connected thereto, said bottom tabs being of sufficient length to form a right triangle with said first bottom flap and the back panel, thereby providing an opening corresponding to the configuration of the base portion of the elongated bottle, and adapted to receive same.

6. An improved display carton with retaining panels as in claim 5 wherein the edge of each respective tab and bottom tab forming the central openings is generally arcuate extending from front to rear of the carton such that the respective central opening is arcuate in configuration to accommodate the end of the elongated bottle.

7. An improved display carton with retaining panels as in claim 5 wherein said bottom glue flap is adhesively bonded to the inside of said first bottom flap.

8. An improved display carton with retaining panels as in claim 5 wherein said front panel includes inwardly directed flaps for forming a shadow box configuration.

9. A blank made of paperboard and adapted to be folded into a display carton with retaining panels of generally rectangular and tubular shape for accommodating an elongated bottle having at one end a cap, while the other end is a closed base portion, with the width of the erected display carton being greater than the width of the cap, and comprising:

a substantially rectangular sheet of said paperboard, said sheet having opposed vertical lateral edges and opposed horizontal top and bottom edges, the length of the blank between said top and bottom edges thereof corresponding to the length of the bottle;

four vertically spaced parallel hinge lines intermediate the lateral edges thereof defining a pair of side walls, a front panel, a back panel, and a manufacturer's glue flap positioned at one lateral edge thereof;

said side walls and said front panel having end closure flaps hingedly attached to the top and bottom edges thereof along said top and bottom horizontal edges;

said back panel having a first rectangular flap hingedly attached along the top edge thereof;

said first flap having a top panel retaining structure hingedly attached thereto along a horizontal fold line;

said top panel retaining structure including a glue flap hingedly connected along a horizontal fold line to said first flap, with the length of said glue flap being less than the length of said first flap; and a pair of projecting tabs hingedly connected to the opposite ends of said glue flap and extending generally perpendicular to the length of said glue flap so as to define a central opening, with the sum total of the projected length of said tab from front to rear and the length of the glue flap being greater than the total length, from front to rear, of said first flap.

10. A blank made of paperboard as in claim 9 further including a back retaining panel structure, said bottom panel having a second rectangular flap hingedly attached along the bottom edge thereof; said bottom panel retaining structure including a bottom glue flap hingedly connected along a horizontal fold line to said second flap, with the length of said bottom glue flap being less than the length of said second flap; and a pair of projecting bottom tabs hingedly connected to the opposite ends of said bottom glue flap and extending perpendicular to the length of said bottom glue flap so as to define a bottom central opening, with the sum total of the projected length of each bottom tab from front to rear and the length of the bottom glue flap being greater than the total length, from front to rear, of said second flap.

11. A blank as in claim 10 wherein said front panel includes hingedly connected shadow box flap portions.

* * * * *

UNITED STATES PATENT AND TRADEMARK OFFICE

CERTIFICATE OF CORRECTION

PATENT NO. : 4,128,168

DATED : December 5, 1978

INVENTOR(S) : HARRY I. ROCCAFORTE

It is certified that error appears in the above-identified patent and that said Letters Patent are hereby corrected as shown below:

In Column 2, line 68, delete "were" and insert in lieu thereof -- where --.

In Column 3, line 47, delete "72" and insert in lieu thereof -- 76 --.

In Column 4, line 40, delete "based" and insert in lieu thereof -- base --.

Signed and Sealed this

*Thirteenth* Day of *May 1980*

[SEAL]

*Attest:*

SIDNEY A. DIAMOND

*Attesting Officer*

*Commissioner of Patents and Trademarks*